US007921617B2

(12) United States Patent
Stevens

(10) Patent No.: US 7,921,617 B2
(45) Date of Patent: Apr. 12, 2011

(54) STRUCTURAL PANEL UTILIZING A LATH AND FRAME MEMBER AND METHOD FOR MAKING THE SAME

(76) Inventor: Donald A. Stevens, Winchester, VA (US)

( * ) Notice: Subject to any disclaimer, the term of this patent is extended or adjusted under 35 U.S.C. 154(b) by 0 days.

(21) Appl. No.: 12/472,044

(22) Filed: May 26, 2009

(65) Prior Publication Data

US 2009/0229207 A1 Sep. 17, 2009

Related U.S. Application Data

(60) Division of application No. 10/790,628, filed on Mar. 1, 2004, now abandoned, which is a continuation-in-part of application No. PCT/US02/27876, filed on Aug. 30, 2002.

(60) Provisional application No. 60/315,994, filed on Aug. 30, 2001.

(51) Int. Cl.
*E04B 9/00* (2006.01)

(52) U.S. Cl. ..... 52/356; 52/364

(58) Field of Classification Search ..... 52/364, 52/372, 373, 344, 349, 351, 355, 356, 357, 52/359, 360, 319, 322, 333
See application file for complete search history.

(56) References Cited

U.S. PATENT DOCUMENTS

| | | | | |
|---|---|---|---|---|
| 247,370 | A | 9/1881 | Lloyd | |
| 764,989 | A | 7/1904 | Chester | |
| 815,292 | A * | 3/1906 | Hegbom | 52/356 |
| 948,414 | A | 2/1910 | Clark | |
| 963,938 | A * | 7/1910 | Phillips | 52/356 |
| 1,008,877 | A | 11/1911 | White | |
| 1,014,616 | A | 1/1912 | White | |
| 1,014,617 | A | 1/1912 | White | |
| 1,112,181 | A | 9/1914 | White | |
| 1,309,241 | A | 7/1919 | Clark | |
| 1,824,082 | A | 9/1931 | Hernandez | |
| 2,001,733 | A | 5/1935 | Kellogg | |
| 3,417,519 | A | 12/1968 | Hitter | |
| 3,496,691 | A | 2/1970 | Seaburg et al. | |
| 3,991,536 | A | 11/1976 | Rutherford | |
| 4,885,884 | A * | 12/1989 | Schilger | 52/354 |
| 5,172,527 | A | 12/1992 | Ault | |
| 5,259,157 | A | 11/1993 | Ault | |
| 5,481,843 | A | 1/1996 | Kreikemeier | |
| 5,540,023 | A * | 7/1996 | Jaenson | 52/343 |
| 6,185,899 | B1 * | 2/2001 | De Niet | 52/762 |
| 2007/0271866 | A1 * | 11/2007 | Stevens | 52/483.1 |

FOREIGN PATENT DOCUMENTS

| | | |
|---|---|---|
| EP | 0159764 B1 | 5/1989 |
| EP | 0434869 A1 | 7/1991 |
| JP | 10237994 | 9/1988 |
| JP | 03286029 | 12/1991 |
| JP | 03290555 | 12/1991 |
| JP | 06158858 | 6/1994 |
| JP | 08270142 | 10/1996 |
| JP | 09279806 | 10/1997 |
| JP | 10169189 | 6/1998 |

* cited by examiner

*Primary Examiner* — Brian E Glessner
*Assistant Examiner* — Jessica Laux
(74) *Attorney, Agent, or Firm* — The Webb Law Firm

(57) ABSTRACT

A structural panel and method of making the same are disclosed wherein the structural panel has at least one frame member with receptor pockets extending therein. Ribs protruding from a lath are resiliently engaged within the receptor pockets thereby securing the lath against the frame member. A structural coating is secured to the lath thereby providing a labor-efficient, low-cost structural panel available for use for a number of different construction projects.

22 Claims, 9 Drawing Sheets

STRUCTURAL PANEL UTILIZING A LATH AND FRAME MEMBER AND METHOD FOR MAKING THE SAME

CROSS-REFERENCE TO RELATED APPLICATIONS

This application is a divisional of patent application Ser. No. 10/790,628, filed Mar. 1, 2004, entitled "Structural Panel Utilizing A Lath And Frame Member and Method For Making The Same", which application is a continuation-in-part of International Application Number PCT/US02/27876 filed Aug. 30, 2002, which designates inter alia the United States and which claims the benefit of U.S. Provisional Application No. 60/315,994 filed Aug. 30, 2001.

BACKGROUND OF THE INVENTION

1. Field of the Invention

The invention relates to prefabricated structural panels which can be rapidly assembled to form buildings of various types. Specifically the invention relates to structural panels which incorporate a lath connected to frame members.

2. Description of Related Art

There is a widespread need for a building system that uses common construction materials which are readily available throughout the world and can be quickly erected with a minimal labor force, is cost effective and whose construction is capable of withstanding extreme environments. Such a building system must be environmentally friendly while appearing to be similar to traditional buildings and structures and also must be constructed of materials which wisely utilize limited natural resources.

The demand for buildings, especially homes, in many third world countries is high. Additionally, current building methods many times are so slow, outdated and so labor intense that there is no way to satisfy the existing demand. While structures made from stone, block and concrete materials are time-tested and have proven their effectiveness worldwide, a change in building design must occur in order to keep up with this high demand. Portland cement, a common natural resource, has been used throughout the world for over two thousand years to produce concrete, mortar plaster and stucco. Steel has been used and relied upon since the early 1800s. Both portland cement and steel are cost effective and readily available from producers worldwide.

Therefore, a building utilizing a light gauge steel frame that can be covered with a cement exterior/interior coating and that would closely resemble currently existing buildings is desirable.

There are existing building systems that use light gauge laths, meshes, expanded metal or similar materials to build various types of stucco or plaster covered structures. All of these systems utilize discrete mechanical fasteners to attach the lath to the frame and must be used over a solid substrate such as plywood to provide adequate strength and to provide a material to which the fasteners can be attached. Once the lath is fastened, stucco or plaster, each of which is considered to be a cementitious coating, is applied in a series of layers over the substrate. The lath, once embedded in the cementitious coating, acts together with the coating to provide a structure having more strength using a design technique which offers a greater level of flexibility.

There are different types of existing commercial laths. The first type of lath is diamond mesh lath. It is manufactured out of thin sheets of metal that are slit with knives and stretched apart. The lath pattern resembles uniformly spaced small diamond shapes. The diamond mesh lath must be fastened to a substrate with nails or screws and must be used in conjunction with a solid surface because this diamond mesh lath is inherently flexible. The diamond shaped pattern allows the lath not only to be formed for contours but also provide a smooth surface desirable for ornamental work and smooth plaster finishes.

A second type of lath is a self-furring lath which may have a dimpled diamond or high ribbed surface that spaces the lath away from a mounting surface. These self-furring laths enable a structural coating to encapsulate the lath such that the lath is in the middle of the structural coating thereby providing greater strength. Self-furring laths, just as the diamond mesh lath, must be attached to a solid substrate such as plywood or water-resistant gypsum board using nails or screws.

A third type of lath is a lath having diamond patterns and having continuous flat ribs of steel which has a unique shape for added strength and support. This type of lath can be used over an open frame and does not require attachment to a solid substrate. However, this type of lath is limited for use on spans no greater than 16 inches and is not self-furring. In particular, one typical lath includes three 16-inch flat ribs spaced on 2-inch centers which run the continuous length of the lath. However, once again, these ribbed laths must be mechanically fastened to one another using discrete fasteners.

Finally, a flat-ribbed lath having a diamond shape in a reverse herringbone pattern may have V-shaped ribs that run the length of the lath. In one instance, ⅜-inch V-shaped ribs are spaced at 4½ inch intervals and provide structural support on open framed cavities having framing members spaced less than 16 inches apart. However, once again this type of lath must be mechanically fastened using discrete fasteners.

Each of these laths when used to cover a 2-foot by 8-foot area, requires between 36-45 fasteners. Not only do these fasteners add to the overall material costs, but also the time required to apply these fasteners increases the cost of labor and the overall time of construction.

Light gauge framing components made from coils of thin metal having various thicknesses and widths have existed for more than forty years. Such framing components typically consist of a web and a flange extending therefrom.

European Patent No. 159,764 issued to Illinois Tool Works on Oct. 30, 1985 shows a fastener for installing a sheet such as a lath spaced from a support. The lath described therein requires discrete mechanical fasteners.

Japanese Patent No. 03,290,555 issued to Adachi et al. on Dec. 20, 1991 shows a method for fixing an inner wall. This patent discloses a means of attaching a wood beam such as a ceiling or floor beam in a steel fitting means. There is neither a teaching nor a discussion of a lath.

Japanese Patent No. 03,286,029 issued to Misaka on Dec. 17, 1991 illustrates a steel underground wall and method of construction. This patent discloses a seismic reinforcement using a steel grid composed of beams, and neither teaches nor suggests the use of a lath.

European Patent No. 434869 issued to International Building Systems, Inc. on Dec. 15, 1993 illustrates a steel stud and precast panel which requires a fastening means before the introduction of concrete over a steel stud.

Japanese Patent No. 06,158,858 issued to Harino et al. on Jun. 7, 1994 illustrates a form for concrete foundation and describes a means of pouring concrete into a panel. This patent neither teaches nor discusses the use of a lath.

Japanese Patent No. 08,270,142 issued to Miyata on Oct. 15, 1996 illustrates a steel stud for a partition wall used in a coupling system for holding fireproof boards. There is neither a teaching nor a discussion of the use of a lath.

Japanese Patent No. 09,279,806 issued to Hosoda on Oct. 28, 1997 discloses a method for fixing a rib lath utilizing a means for fastening a lath including screw attachments to pierce through the lath at recess points.

Japanese Patent No. 10,161,189 issued to Hosoda on Jun. 23, 1998 illustrates a ribbed lath used as a form. This patent neither teaches a self-setting lath system nor suggests that the lath be applied to a stud.

Japanese Patent No. 10,237,994 issued to Shiozo et al. on Sep. 8, 1998 discloses a concrete panel made up of a lath and steel studs and a method utilizing heat to attach the lath to the steel studs.

A design for applying a lath to a frame is desired which requires no discrete fasteners for permanent connection and requires no solid substrates upon which to secure the lath.

SUMMARY OF THE INVENTION

A first embodiment of the subject invention is directed to a lath for use with a frame member for a structural panel comprising a generally planar sheet having a front side and a back side with a plurality of ribs formed within the sheet. The ribs protrude from the back side of the sheet and each rib has a profile with a first side and a second side which diverge from one another as they extend away from the back side and then converge. The maximum height of a rib occurs at the place of maximum divergence and a plurality of slats extends through the sheet for adapting the sheet to receive and retain thereupon a structural coating.

A second embodiment of the subject invention is directed to a structural panel comprising at least one frame member having a longitudinal axis and a plurality of receptor pockets extending within the frame member in a direction generally perpendicular to the longitudinal axis. A lath is connected to the at least one frame member and the lath has a plurality of resilient ribs extending therefrom. The ribs resiliently engage corresponding receptor pockets within the at least one frame member to secure the lath to the at least one frame member.

A third embodiment of the subject invention is directed to a method of making a structural panel utilizing at least one frame member having a longitudinal axis and a plurality of receptor pockets extending within the frame member in a direction generally perpendicular to the longitudinal axis. A lath having a plurality of resilient ribs extending therefrom is adapted to resiliently engage corresponding receptor pockets within the at least one frame member. The method comprises the steps of aligning the ribs of the lath with matching receptor pockets in each of the frame members, and urging each rib within the matching receptor pocket of the frame member until each rib snaps into position.

DESCRIPTION OF THE PREFERRED EMBODIMENTS

The present invention is a light gauge lath and framing system to provide a structured panel for roofs, floors, ceilings, foundations, basement walls, verandahs, decks, fences and interior and exterior walls in building construction. The structural panel in accordance with the subject invention can be assembled without the use of discrete fasteners and is able to stand between frame members without the use of a solid substrate.

Figure 1:
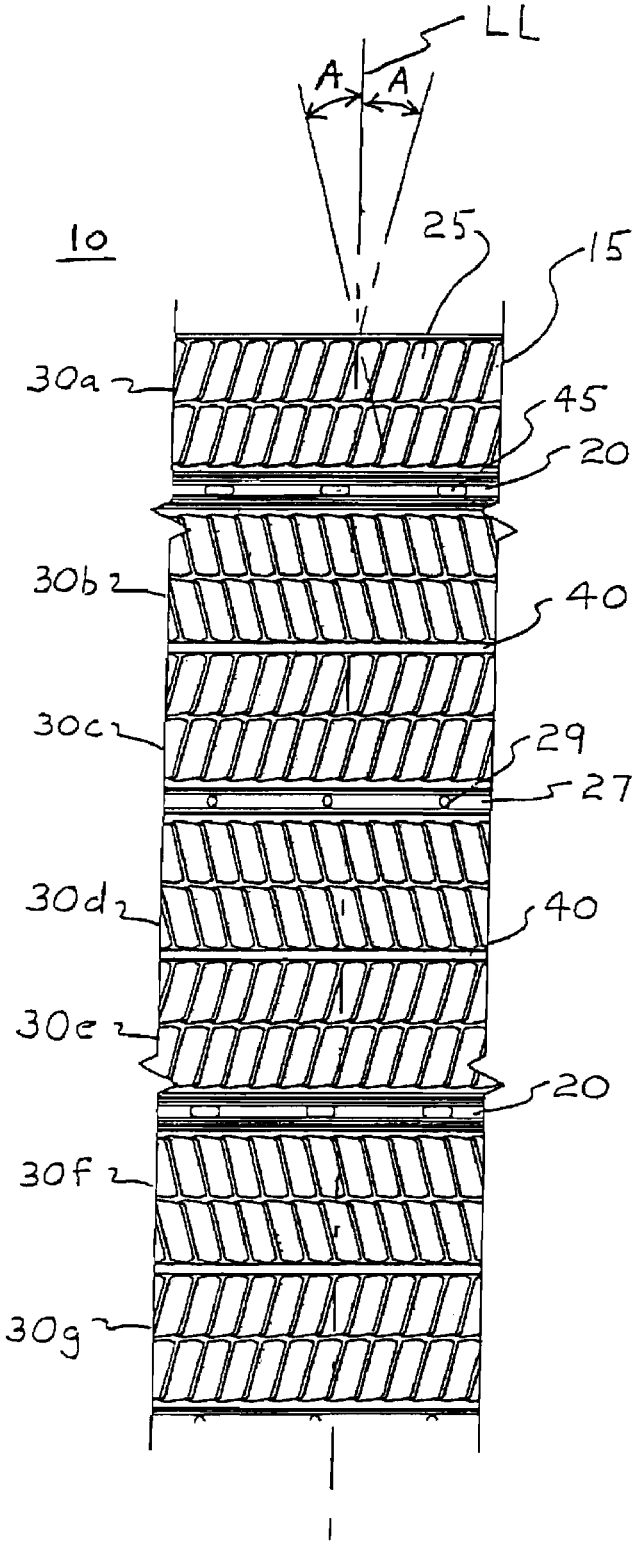
FIG. 1 show a front elevation view of a section of a ribbed channel lath in accordance with the subject invention.
Figure 2:
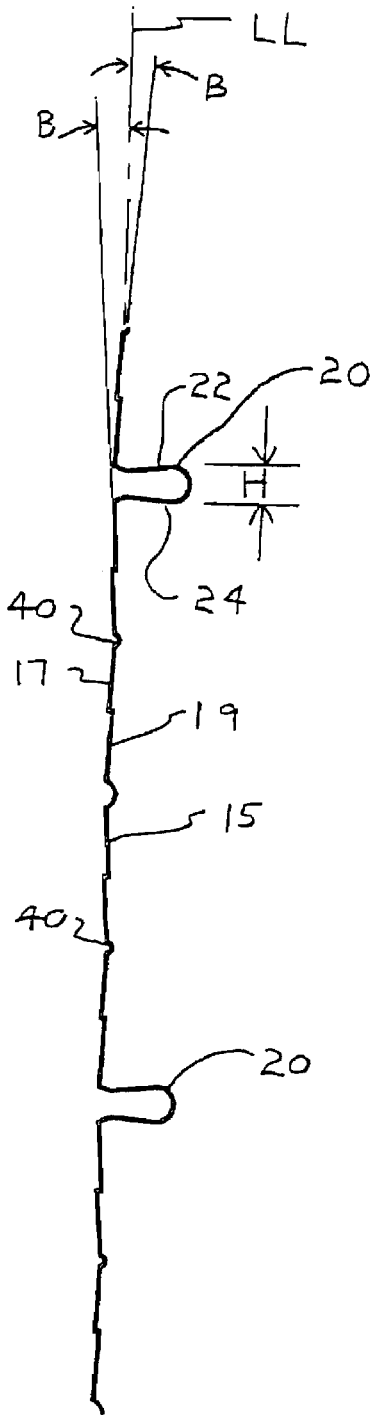
FIG. 2 is a side view of the lath illustrated in FIG. 1.

Directing attention to FIGS. 1 and 2, a lath 10 is made up of a generally planar sheet 15 having a front side 17 and a back side 19. A plurality of ribs 20 are formed within the sheet 15. Each rib 20 protrudes from the back side 19 of the sheet 15. Furthermore, each rib 20 has a profile with a first side 22 and a second side 24 which diverge from one another as they extend away from the back side 19 and then the first side 22 and the second side 24 converge to intersect. Each rib has a maximum height H which occurs at the place of maximum divergence of the first side 22 and the second side 24. Each rib 20 may extend across the lath in an interrupted pattern such that each rib 20 is a plurality of protrusions.

A plurality of slats 25 extends through the sheet 15 for adapting the sheet 15 to receive and retain thereupon a structural coating (not shown). The sheet 15 may be constructed from a thin, pliable material such that the ribs 20 are resilient and may be compressed to reduce the maximum height H and snapped into apertures or slots in a frame member. The sheet 15 may be made from any number of materials that are resilient and provide the desired shape such as metal, plastic and carbon fiber composites.

The sheet 15 has a plurality of segments 30 (distinguished by reference numbers 30*a*-30*g*) with the slats 25 therein wherein the slats 25 within adjacent segments, segments 30*a* and 30*b* for example, are oriented differently to securely engage any structural coating (not shown) that may be applied to the sheet 15. As illustrated in FIG. 1, the slats 25 within a segment 30*a* are parallel to one another. The sheet 15 has a longitudinal axis LL and each slat 25 lies along a line to define a slat vertical angle A with the longitudinal axis LL. The slat vertical angle A formed by the slats 25 in one segment 30*a*, for example, is equal and opposite to the slat vertical angle A formed by the slats 25 in an adjacent segment 30*b* for example. Additionally, each segment 30*a-g* of slats 25 may form a slat planar angle B with the longitudinal axis LL of a lath 10. The slat planar angle B of the slats 25 in one segment for example, segment 30*a* may be equal to and opposite the slat planar angle B formed by the slats 25 in an adjacent segment, for example, segment 30*b*.

A plurality of divots 40 may be formed within the front side 17 of the sheet 15 to provide protrusions from the back side 19 of the sheet 15, such that the sheet 15 may be spaced from any flat surface upon which it may be applied.

A structural coating (not shown) may be applied to the lath and, for that reason, each rib 20 may have a plurality of holes 45 extending therethrough to provide pressure relief to any structural coating that may be applied to the sheet 15.

Figure 3:
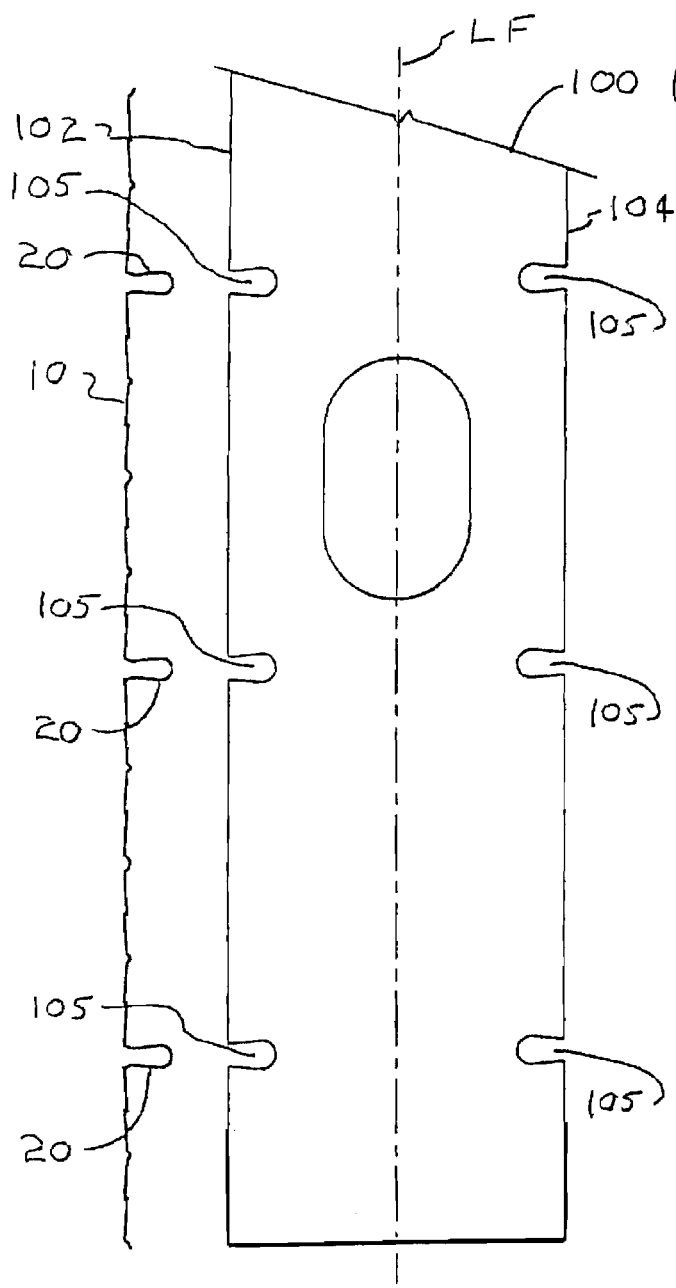
FIG. 3 is an exploded side view of the lath in position to be mounted upon a frame member.
Figure 4:
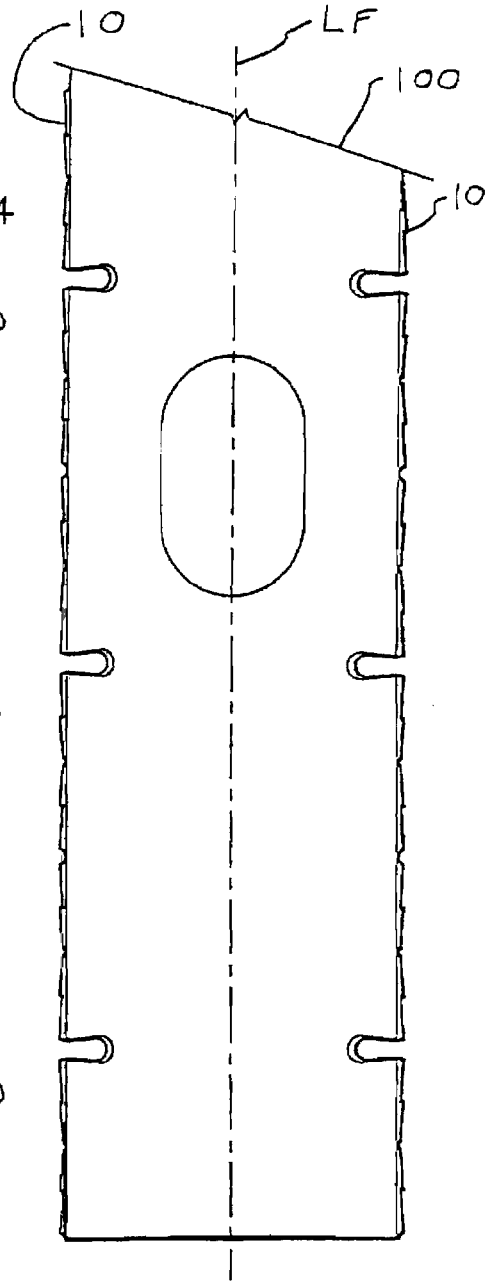
FIG. 4 is a side view of the lath mounted upon the frame member.
Figure 9:
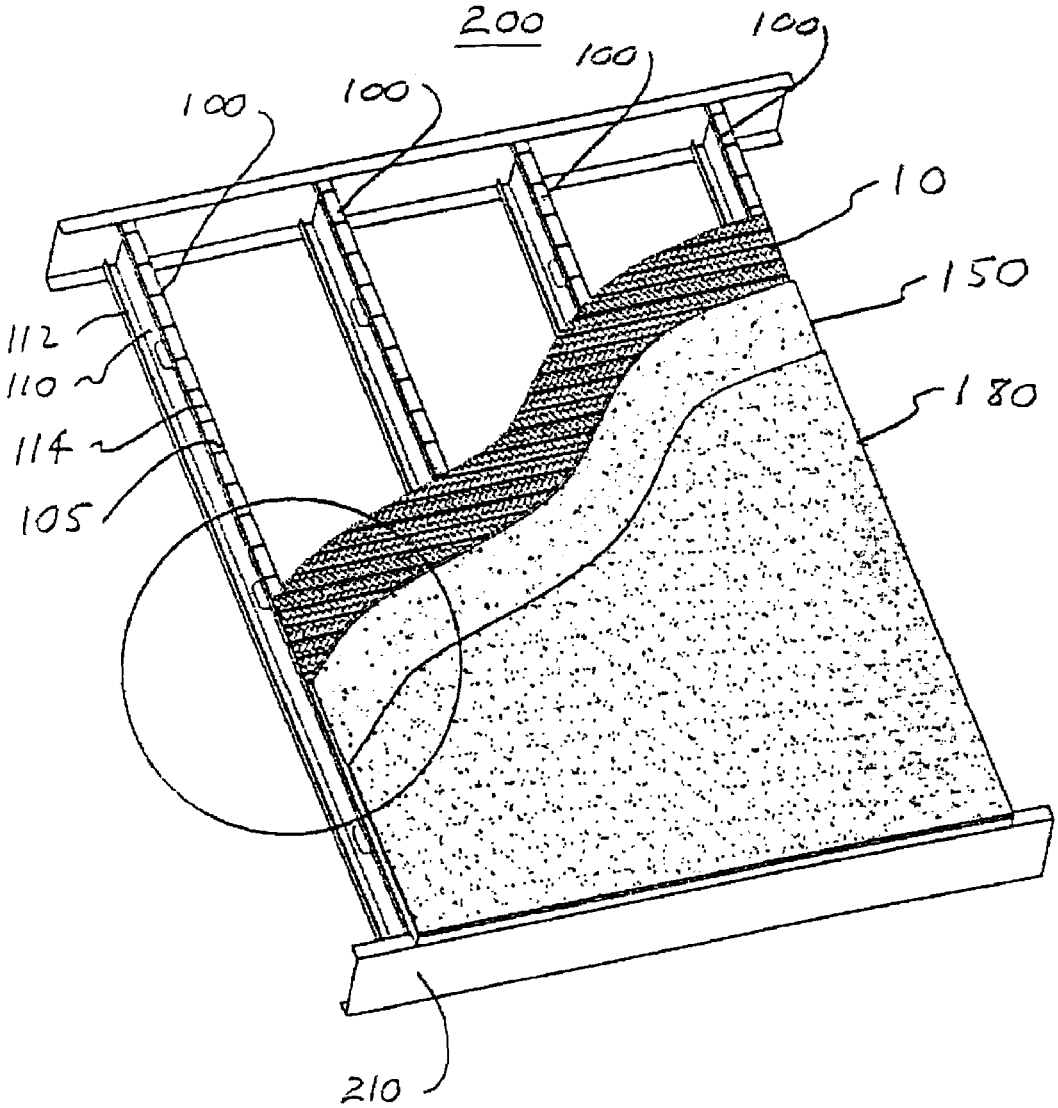
FIG. 9 is a perspective view of a structural panel in accordance with the subject invention.

FIGS. 3 and 4 illustrate the manner in which the lath 10 may be secured to a frame member 100. As illustrated in FIG. 9, a lath 10 may be secured to a plurality of frame members 100 to form a structural panel 200.

Directing attention to FIGS. 3 and 4, the structural panel 200 (FIG. 9) may be comprised of, at least one frame member 100 having a longitudinal axis LF and a plurality of receptor pockets 105 extending within the frame member 100 in a direction generally perpendicular to the longitudinal axis LF.

The lath 10 is connected to the frame member 100 through the plurality of resilient ribs 20 extending therefrom. The ribs 20 resiliently engage corresponding receptor pockets 105 within the frame member 100 to secure the lath 10 to the frame member 100. Each receptor pocket 105 extends from a first side 102 of the frame member 100 and the lath 10 is secured to this first side 102.

The receptor pockets 105 may extend from both the first side 102 and an opposing second side 104 of a frame member 100. Under these circumstances, the lath 10 may be secured to the first side 102 of the frame member 100 while a second lath (10 in FIG. 4) may be secured to the second side 104 of the frame member 100.

Figure 5:
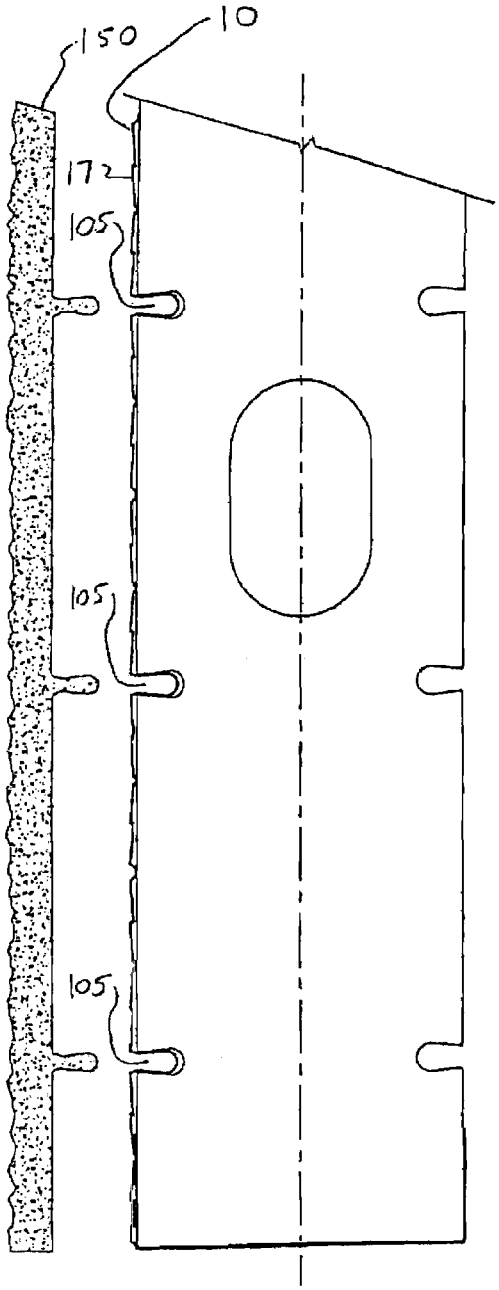
FIG. 5 is an exploded view of the lath mounted upon a frame member with a structural coating spaced therefrom.
Figure 6:
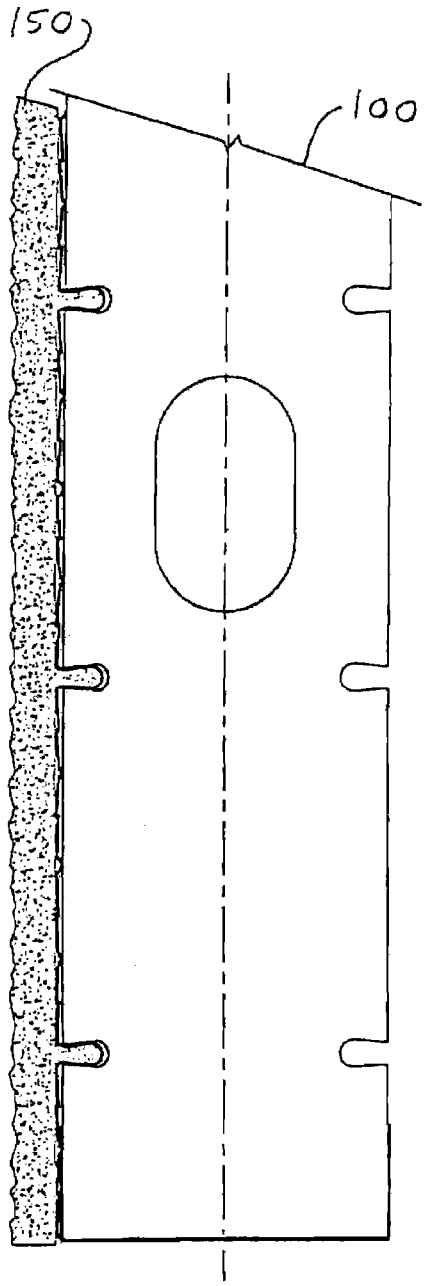
FIG. 6 is a side view of the components illustrated in FIG. 5 but assembled.

As illustrated in FIGS. 5 and 6, a base structural coating 150 may be applied to the front side 17 of the lath 10. The structural coating 150 penetrates through the slats 25 (FIG. 1) and the receptor pockets 105. Since the ribs 20 of the lath 10 must be compressed to snap within the receptor pockets 105 of the frame member 100, once the lath 10 is secured to the frame member 100, when the structural coating 150 is applied, the coating 150 not only permeates the slats 25 but furthermore fills the remaining volume within each receptor pocket 105. The structural coating 150 hardens within a receptor pocket 105 and the rib 20 becomes permanently secured within the receptor pocket 105 because the hardened structural coating 150 prevents the rib 20 from compressing, which would be required to remove the rib 20 from the receptor pocket 105. This provides a permanent connection for the ribs 20 of the lath 10 into the receptor pockets 105 because of the unique one-way fitting design of the panel.

The base structural coating 150 may be stucco or plaster. The lath 10 may be metal and the frame member 100 may be light gauge steel.

Figure 7:
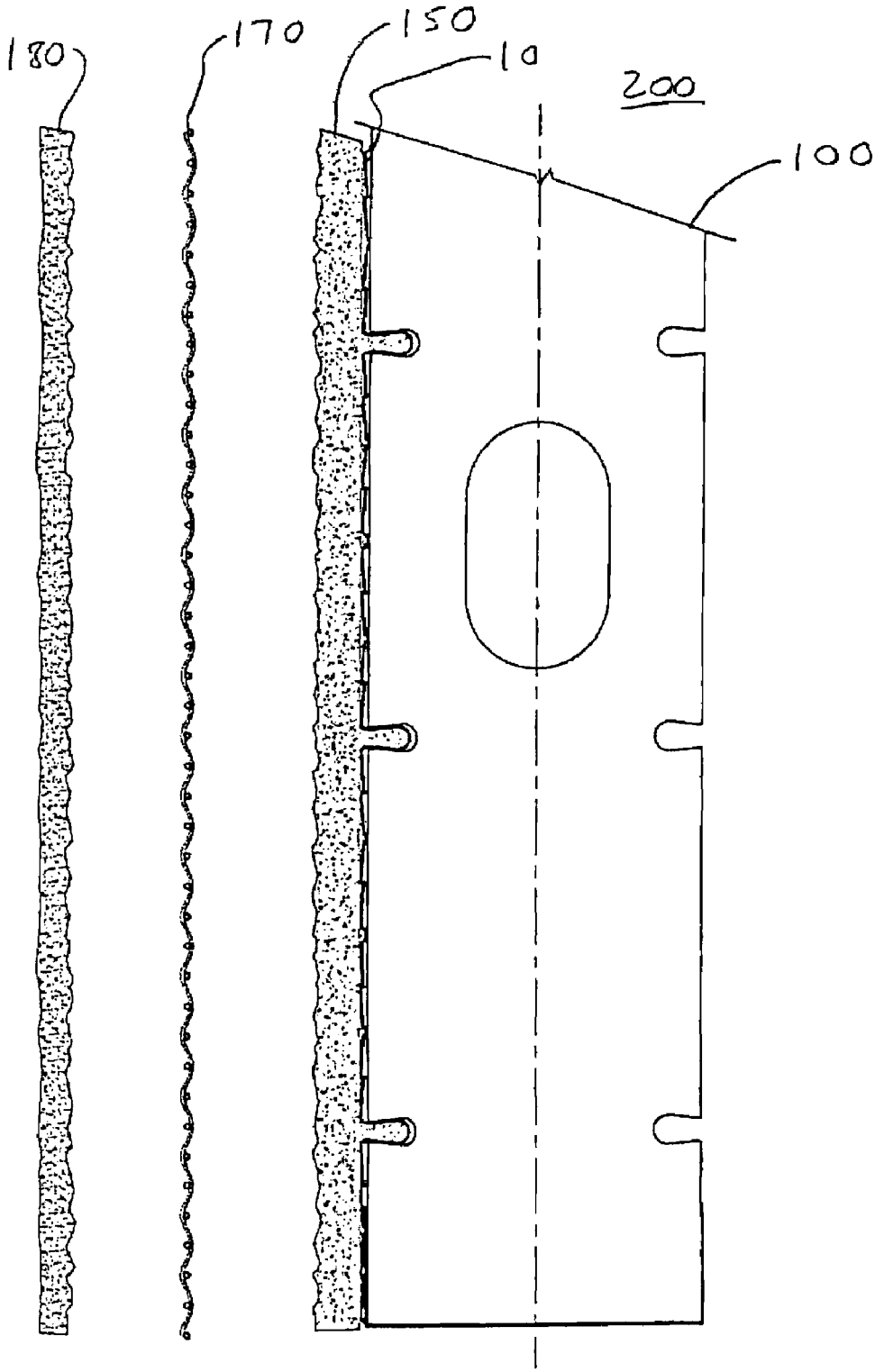
FIG. 7 is a side view of the assembled frame member, lath and base structural coating having exploded therefrom a screen and a supplemental structural coating.

Directing attention to FIG. 7, the structural panel may further include a structural mesh 170 which may be embedded within the base structural coating 150. In particular, in areas that are prone to seismic activity and extreme whether conditions, the structural mesh 170 applied to the base structural coating 150 may reduce the chance of cracking and increase the overall strength of the structural panel 200 (FIG. 9). The structural mesh 170 may be adhered, fabricated or attached to each lath 10 in an offset pattern. The offset pattern allows for the structural mesh 170 to overlap other laths 10 by creating a uniform covering which may overlap for example by as much as two inches on each lath 10.

Figure 8:
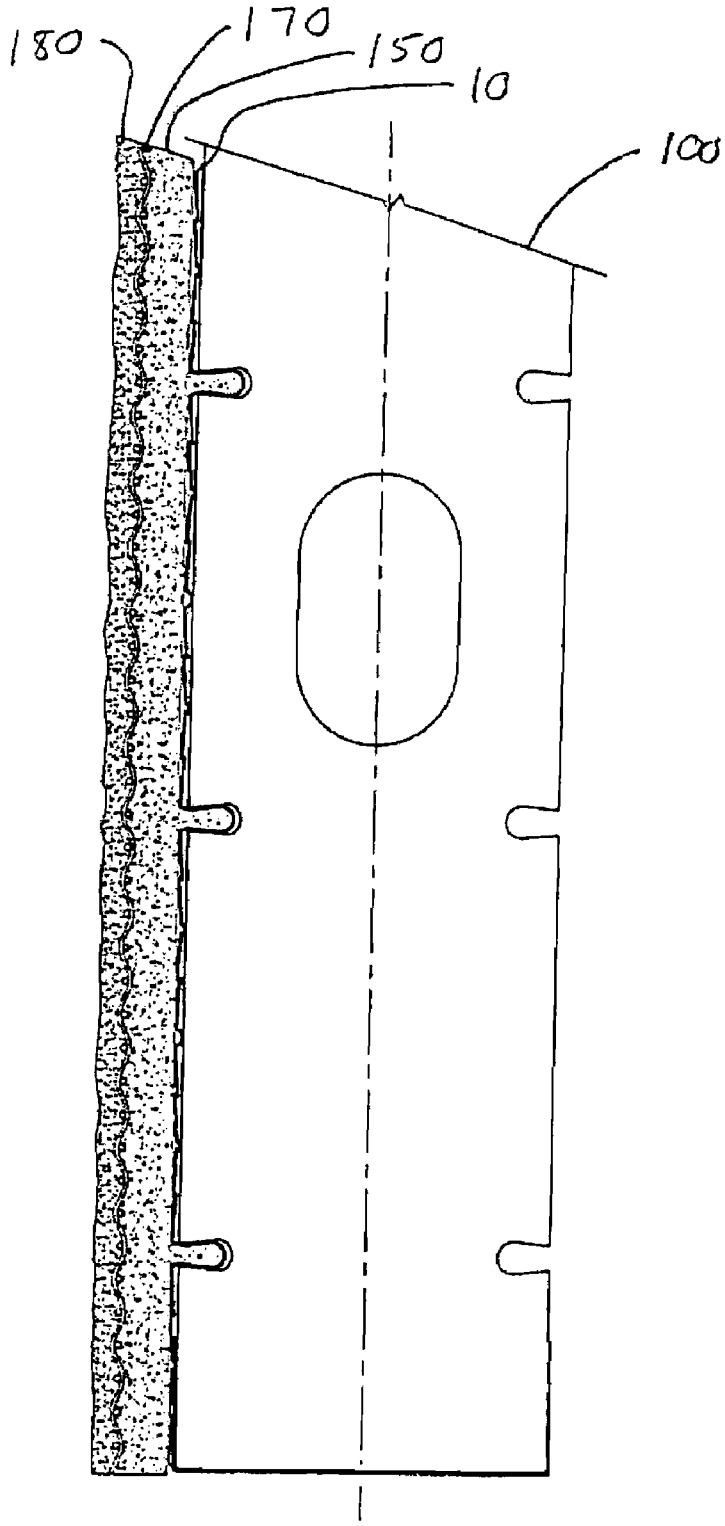
FIG. 8 is a side view of the elements illustrated in FIG. 7 but assembled.

The structural mesh 170 may be supported from the top of the partially constructed structural panel 200 and a person applying the base structural coating 150 may lift the structural mesh 170 up while the base structural coating 150 is being applied. Once an area has been coated with the base structural coating 150, the structural mesh 170 is then released and lightly pressed into the base structural coating 150, which has not yet solidified. The structural mesh 170 may be pressed below the surface of the base structural coating 150. The texture of the structural mesh 170 will increase the bond for any subsequent coating which may be added and furthermore will increase the strength of the base structural coating 150 and reduce the chance of cracking, surface spalling or peeling. In addition to the structural mesh 170, it is also possible to include a supplemental structural coating 180 over the structural mesh 170 and over the base structural coating 150. This supplemental structural coating 180 may be formulated to provide a desirable exterior finish. FIG. 8 illustrates the elements of FIG. 7 assembled. The frame member 100 has attached thereto the lath 10, the base structural coating 150, the structural mesh 170 and the supplemental structural coating 180.

Figure 10:
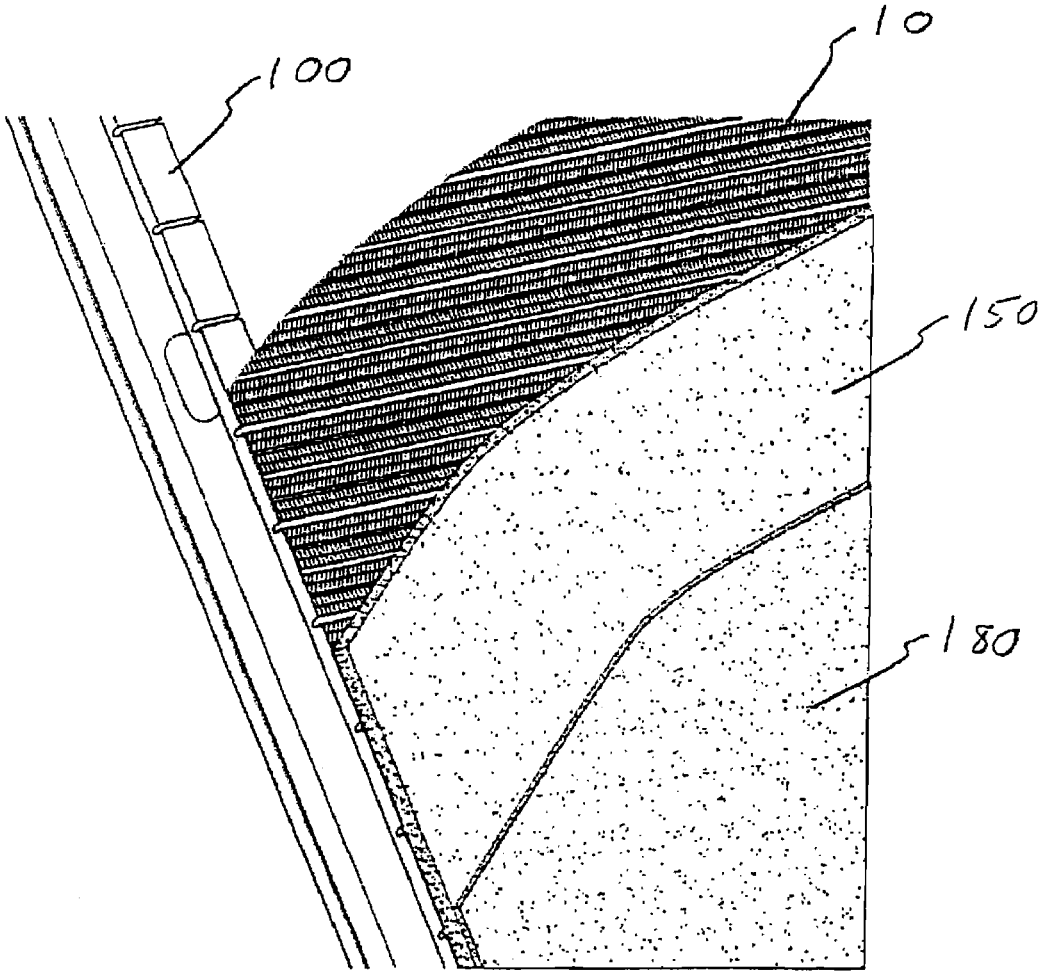
FIG. 10 is a perspective view of an enlarged portion circled in FIG. 9.

FIG. 9 illustrates a structural panel 200 in which frame members 100 are secured to mounting members 205, 210. Additionally, the lath 10 is secured to the frame members 100, the base structural coating 150 is secured to the lath 10 and the supplemental structural coating 180 is secured to the base structural coating 150. It should be understood that the structural mesh 170 (FIG. 7) may also be included, however, for clarity is not illustrated in FIG. 9. FIG. 10 illustrates an enlargement of the portion encircled in FIG. 9 and more clearly illustrates the details of the lath 10 and its attachments to the frame members 100.

The base structural coating 150 and the supplemental structural coating 180 may be applied using one of at least two methods. In a first method a hand trowel may be used to apply the structural coatings. Using this method, the structural coatings may be selectively applied with effectiveness. In a second method, the structural coatings may be applied by machine spraying.

Figure 11:
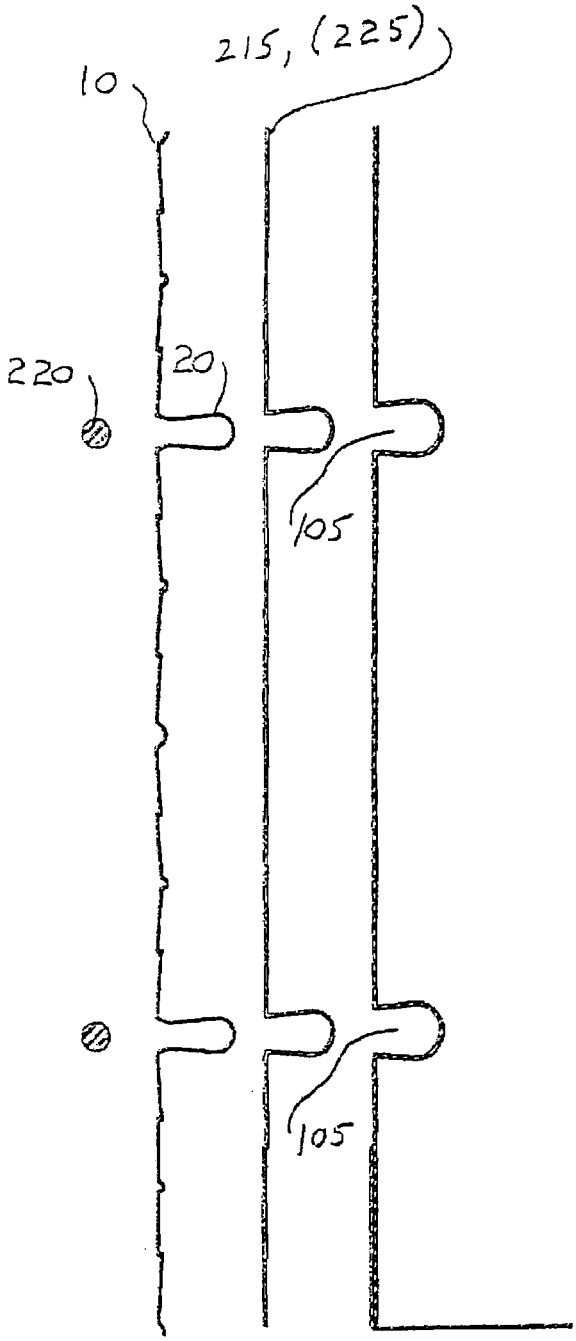
FIG. 11 is an exploded side view of an intermediate barrier, a lath and frame member.

Directing attention to FIG. 11 when the structural coatings are applied by spraying, it is necessary to install a mesh 215 between the lath 10 and the frame member 100 to provide a backdrop. The purpose of this backdrop mesh 215, which may, for example, be made of fiberglass or of a carbon fiber composite, is to catch any structural coating spray that goes through the openings of the lath 10. This backdrop mesh 215, as illustrated in FIG. 11, is placed between the frame member 100 and the lath 10 is placed over the backdrop mesh 215 and against the frame member 100 such that the ribs 20 of the lath 10 pinch and secure the backdrop mesh 215 within the receptor pockets 105 of the frame member 100. When the lath 10 is pressed into the receptor pockets 105 of the frame member 100, the backdrop mesh 215 becomes permanently attached between the lath 10 and the frame member 100 and at the same time is drawn taut forming another medium upon which the base structural coating 150 may adhere. Although the mesh 215 is illustrated with a geometry generally shaped to the receptor pocket 105, it should be appreciated that the mesh 215 may also be a flat sheet and the force of the ribs 20 will conform the mesh 215 to the shape of the receptor pocket 105. The separated parts illustrated in FIG. 11 are shown assembled in FIG. 12.

Figure 12:
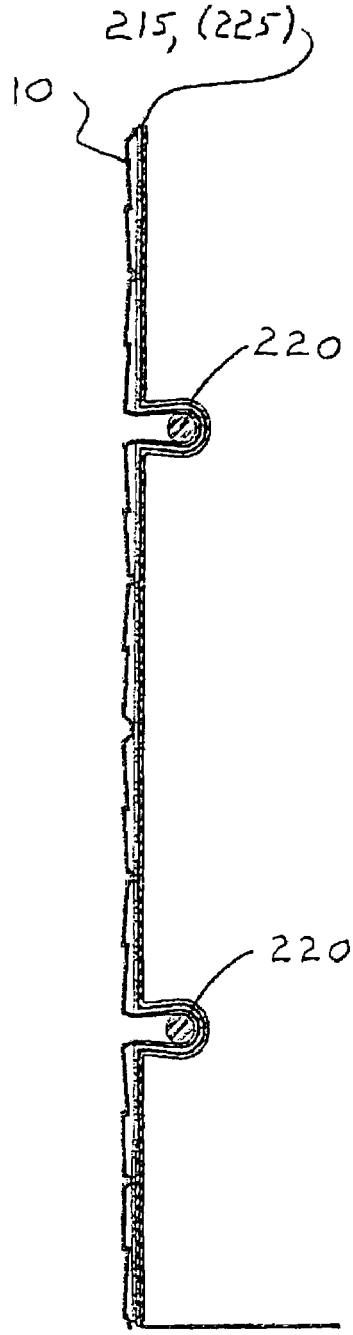
FIG. 12 is a side view of the intermediate layer and lath assembled on a frame member.

In lieu of, or in addition to the structural coatings being placed over the lath 10 and into the receptor pockets 105 of the frame members 100 to increase the strength between spans, as illustrated in FIG. 12, a reinforcement bar 220 may be positioned within the ribs 20 of the lath 10 to lock the lath 10 within the frame member 100 and to provide additional structural stiffness to the structural panel 200. The use of reinforcement bars 220 inside the receptor pockets 105 furthermore increases the strength and reduces the side-to-side rotational movement while at the same time provides a permanent connection of the lath 10 into the receptor pockets 105 because of the unique one-way fitting design in the panel 200. This application would be typical in a floor application where the live and dead building loads are considerably higher than the loads to which walls, ceilings and roofs are subjected.

In areas of dramatic changes in temperature, a thermal break may be introduced between the lath 10 and the frame member 100. Referring again to FIGS. 11 and 12, while the backdrop mesh is indicated by reference number 215, an element having a very similar appearance could be used as the thermal break. For that reason, reference number 225 listed in parentheses will also be used in FIGS. 11 and 12 to indicate that when a thermal break 225 is utilized, it will appear similar to and be secured in a similar way as the backdrop mesh 215 illustrated therein. The thermal break 225 positioned between the lath 10 and the frame member 100 provides a thermal barrier that will disrupt any conductive heat flow from the lath 10 to the frame member 100. The thermal break 225 may be comprised of a liquid gasket applied over the lath 10 or, in the alternative, may be comprised of a one-piece gasket secured to the frame member 100. As shown the thermal break 225 has a shape similar to that of the frame member 100 and receptor pockets 105. However, the thermal break 225 may also be a non-conforming sheet conformed to the receptor pockets 105 by the force of the ribs 20. Although the thermal break 225 will be compressed between the lath 10 and the frame member 100, the thermal break 225 may also be secured to the frame member 100 using adhesive.

Returning to FIGS. 3 and 4, a method of making the structural panel 200 herein described, comprises the step of aligning the ribs 20 of the lath 10 with the matching receptor pockets 105 at each frame member 100 and then urging each rib 20 within the matching receptor pocket 105 of the frame member 100 until the rib 20 snaps into position. Using a plastic mallet or a rolling machine, the lath 10 is pushed into the frame member 100. Directing attention to FIGS. 5 and 6, the method may also comprise the step of coating the lath 10 with a base structural coating 150. Furthermore, after the ribs 20 of the lath 10 are positioned within the receptor pockets 105 of the frame member 100, reinforcement bars 220 (FIG. 12) may be inserted within the ribs 20 to lock the ribs 20 within each receptor pocket 105.

Each lath 10 has a plurality of fastening grooves 27 (FIG. 1) with holes 29 therein, to hold screws used to mount the lath 10 to a structure during shipping only. Optionally, additional screws can be applied at the four corners of the structural panel 200 to improve the strength of the panel 200 when shipping and handling. It should be noted, however, that such screws are not required for attaching the lath 10 to the frame member 100.

The subject invention provides a structural panel 200 having laths 10 which are connected to frame members 100 without the use of any discrete fasteners. Pressing the lath 10 into the frame member 100 is a more cost-effective method than attaching a lath 10 to the steel frame 100 since there are no discrete fasteners to install. Furthermore, installation is safer and labor costs are reduced.

The lath 10, in accordance with the subject invention, provides a continuous surface for structural coatings to be applied. When these ribs 20 of the lath 10 are integrated within the receptor pockets 105 of the frame member 100, the increase in structural integrity keeps the components from side-to-side and rotational movement.

The frame member 100, as illustrated in FIG. 9, may be a C-shaped member comprised of a base 110 having a flange 112 on one side of the base 110 and an opposing flange 114 on the opposite side of the base 110. As illustrated in FIG. 9, the frame member 100 includes receptor pockets 105 in only flange 114. Under these circumstances, the lath 10 may be applied only to a single side of the frame member 100. In the alternative and as illustrated in FIG. 3, it is possible for the frame member 100 to have receptor pockets 105 on both sides of the frame member 100 thereby, as further illustrated in FIG. 4, permitting lath 10 to be applied to both sides of the frame member 100.

The structural panel 200, in accordance with the subject invention may have frame members spaced over 24" at canter, thereby reducing the number of components for a panel which typically has frame members on 16" centers.

The figures have illustrated a rib 20 extending completely across the lath 20 and receptor pockets 105 extending completely across the frame member 100. It is possible for the rib 20 to extend across the lath 10 in an interrupted pattern to mate with a receptor pocket 105 that extends across the front 102 of the frame member 100 or to mate with receptor pockets 105 that are positioned on the front 102 of the frame member 100 to correspond with the locations of the interrupted pattern ribs.

Figure 13A:
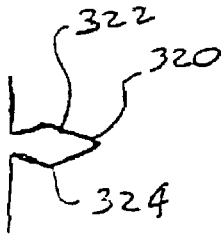
FIGS. 13A-13G illustrate sketches of different rib profiles.
Figure 13B:
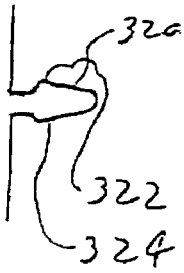
Figure 13C:
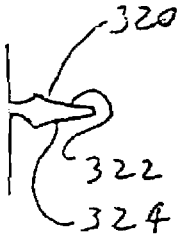
Figure 13D:
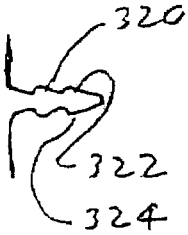
Figure 13E:
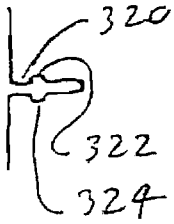
Figure 13F:
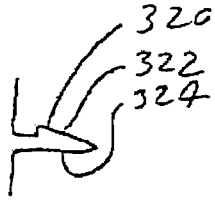
Figure 13G:
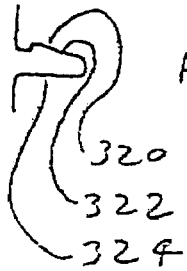

Furthermore, the ribs 20 so far discussed have been in the general shape of a tear drop. A number of other rib shapes may be used in as much as these ribs may be snapped into the frame member 100. FIGS. 13A-13G illustrate a few such rib 320 shapes. In each of these shapes, the first side 322 diverges from the second side 324 and then converges. As a result, these ribs 320 may snap into an appropriately sized receptor pocket located in the frame member. As illustrated in FIGS. 13F and 13G, each rib 320 may resemble a barb.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A structural panel comprising:

a) at least one frame member having a longitudinal axis and a plurality of receptor pockets extending within the frame member in a direction generally perpendicular to the longitudinal axis; and b) a lath connected to the at least one frame member, wherein the lath has a plurality of resilient ribs extending therefrom and wherein the ribs resiliently engage corresponding receptor pockets within the at least one frame member to secure the lath to the at least one frame member, wherein the lath is further comprised of:

1) a generally planar sheet having a front side and a back side, wherein the sheet has a plurality of slats with openings extending therebetween through the sheet;

2) wherein the ribs are formed within the sheet and protrude from the back side of the sheet;

3) wherein each rib has a profile with a first side and a second side which diverge from one another as they extend away from the back side and then converge to a tip at the furthermost extension of the rib away from the back side; and 4) wherein the first side and the second side of each rib are spaced apart from one another with a gap therebetween as they extend away from the back side until they intersect at the tip.

2. The structural panel in accordance to claim 1, wherein the receptor pockets extend from a first side of each frame member and the lath is secured to this first side.

3. The structural panel in accordance with claim 1, where the receptor pockets extend from both the first side and an opposing second side of each frame member and further including a second lath wherein a lath is secured to each the first side and the second side of the frame member.

4. The structural panel according to claim 1, further including a mesh between the lath and the frame to provide a backdrop for any structural coating that may be applied to the structural panel.

5. The structural panel according to claim 4, wherein the mesh is made from one of the group consisting of fiberglass and carbon fiber composites.

6. The structural panel according to claim 1, further including a thermal break between the lath and the frame to provide a thermal barrier that will disrupt any conductive heat flow from the lath to the frame.

7. The structural panel according to claim 6, wherein the thermal break is comprised of a liquid gasket applied over the lath.

8. The structural panel according to claim 6, wherein the thermal break is comprised of a one piece gasket secured to the frame member with adhesive.

9. The structural panel according to claim 1, further including reinforcement bars positioned within the ribs of the lath to lock the lath within the frame member and to provide additional structural stiffness to the structural panel.

10. The structural panel according to claim 1, further including a structural coating applied on the front side of the lath and permeating through the slats and the receptor pockets to further secure the lath to the frame member.

11. The structural panel according to claim 10, wherein the structural coating is stucco.

12. The structural panel according to claim 10, wherein the structural coating is plaster.

13. The structural panel according to claim 1, wherein the lath is metal and the frame is light gauge steel.

14. The structural panel according to claim 1, wherein each receptor pocket extends continuously across the frame member.

15. The structural panel according to claim 1, wherein the receptor pockets are apertures extending through one or both of the first side and the second side of the frame member.

16. The structural panel according to claim 1, wherein each rib extends across the lath in an interrupted pattern.

17. The structural panel according to claim 1, wherein the panel may be used for at least one structural member from the group consisting of roofs, floors, ceilings, foundations, basement walls, verandahs, decks, fences and interior and exterior walls.

18. A method of making a structural panel utilizing at least one frame member having a longitudinal axis and a plurality of receptor pockets extending within the frame member in a direction generally perpendicular to the longitudinal axis and a lath made of a sheet with a plurality of slats with openings extending therebetween through the sheet and wherein the lath has a plurality of resilient ribs extending therefrom and adapted to resiliently engage corresponding receptor pockets within the at least one frame member, wherein each rib has a profile with a first side and a second side which diverge from one another as they extend away from the back side and then converge to a tip at the furthermost extension of the rib away from the back side, and wherein the first side and the second side of each rib are spaced apart from one another with a gap therebetween as they extend away from the back side until they intersect at the tip, wherein the method comprises the steps of:

a) aligning the ribs of the lath with matching receptor pockets in each of the frame members; and b) urging each rib within the matching receptor pocket of the frame member until each rib snaps into position.

19. The method according to claim 18, further comprising the step of coating the lath with a structural coating.

20. The method according to claim 18, further comprising, after the step of urging each rib within the receptor pocket of the frame member, the step of inserting reinforcement bars within the ribs to lock the rib within the receptor pocket.

21. The method according to claim 20, further comprising the step of coating the lath with a structural coating.

22. A structural panel comprising:

a) at least one frame member having a longitudinal axis and a plurality of receptor pockets extending within the frame member in a direction generally perpendicular to the longitudinal axis; and b) a lath connected to the at least one frame member, wherein the lath is comprised of a generally planar sheet having a front side and a back side, wherein the sheet has a plurality of slats with openings extending therebetween through the sheet, and wherein the lath has a plurality of resilient ribs extending therefrom and wherein the ribs resiliently engage corresponding receptor pockets within the at least one frame member to secure the lath to the at least one frame member, wherein each receptor pocket extends continuously and entirely across the frame member.

* * * * *